United States Patent [19]

Ishikawa

[11] Patent Number: 4,517,863

[45] Date of Patent: May 21, 1985

[54] SUCCESSIVE SCREW FEEDER DRIVER

[75] Inventor: Shigeru Ishikawa, Tokyo, Japan

[73] Assignee: Muro Kinzoku Kogyo Co., Ltd., Tokyo, Japan

[21] Appl. No.: 559,370

[22] Filed: Dec. 8, 1983

[30] Foreign Application Priority Data

Dec. 27, 1982 [JP] Japan ..... 57-230489

[51] Int. Cl.[3] ..... B25B 23/02

[52] U.S. Cl. ..... 81/434

[58] Field of Search ..... 81/434

[56] References Cited

U.S. PATENT DOCUMENTS

| | | | |
|---|---|---|---|
| 3,930,297 | 1/1976 | Potucek et al. | 29/240 |
| 4,014,225 | 3/1977 | Lejdegard et al. | 81/434 |
| 4,062,389 | 12/1977 | Lejdegard | 81/434 |
| 4,367,837 | 1/1983 | Manino | 81/434 |

FOREIGN PATENT DOCUMENTS

| | | |
|---|---|---|
| 2641828 | 3/1978 | Fed. Rep. of Germany . |
| 53-37968 | 4/1978 | Japan . |

*Primary Examiner*—James L. Jones, Jr.
*Attorney, Agent, or Firm*—Oblon, Fisher, Spivak, McClelland & Maier

[57] ABSTRACT

A successive screw feeder driver, including a motor housing accommodating an electric motor and a transmission mechanism and formed with a handle, a screw chain magazine holding a continuous screw chain having a great number of screws attached at uniform intervals to a connecting strip by means of an easily breakable filament, a screw drive mechanism for driving said screws, and a screw feed mechanism for feeding said screws one after another to a predetermined driving position. The transmission is mounted between the motor and handle. The screw driving mechanism is projected from the front end of the motor housing by a predetermined length in a direction parallel with the motor. The screw feed mechanism includes a feeder block located in front of the screw driving mechanism for holding in position a screw chain withdrawn from the screw chain magazine, a support member urged to support the feeder block normally in a position projected from the motor housing by a predetermined length and retractable into the motor housing at the time of screw driving operation, and a screw advance mechanism for advancing the screws of the screw chain successively in relation with back and forth reciprocating movement of the feeder block.

16 Claims, 8 Drawing Figures

SUCCESSIVE SCREW FEEDER DRIVER

BACKGROUND OF THE INVENTION

1. Field of the Invention

This invention relates to a power screwdriver mainly for use in attaching wooden material to a metal plate or panel by screws, and more particularly to a power screw feeder driver capable of successively driving screws which are fed in the form of a screw chain carrying a multiplicity of screws on a connecting strip.

2. Description of the Prior Art

In the construction of tall buildings including fifty stories or higher skyscrapers, iron or other metallic structural materials are used in various places and for diversified purposes, including room partitions, window frames etc. In order to facilitate attachment of curtains or other interior furnishings, wooden wall panels or sheets are usually fixed to iron sheets or frames so that one can easily drive nails or wood screws at desired positions on a wall or interior surface.

For attaching a wooden sheet to an iron structure, it has been the conventional procedure to provide female screws in the iron structure beforehand and to drive bolts into the female screws through holes which are formed in the wooden sheet. This wood mounting operation including the tapping of female screws in iron structures and formation of mounting holes in wooden sheets or other material is extremely troublesome particularly in case of a large or tall building which contains a great number of rooms.

In this connection, there have been developed very strong steel screws which are shaped like wood screws and have properties of directly tapping an iron sheet of several millimeters in thickness when driven under pressure by a screw driving tool which is engaged with a groove in the screw head. Accordingly, it has become possible to fix a wooden material to an iron sheet or similar structural material simply by driving screws into the wooden material which is placed on the iron sheet. There has also been known in the art the so-called screw feeder driver which can successively drive screws of this sort, for example, from U.S. Pat. No. 3,930,297, German Ouslegungsschrift No. 2,641,828 and Japanese Publication of Patent Application No. 57-33973.

The above-mentioned prior art screw feeder drivers utilize the construction of the conventional power screw-driver as it is, with a motor power transmission mechanism, a screw feed mechanism and a screw driver successively located forward of a heavy electric motor, so that it has a lengthy shape which is difficult to handle and has various drawbacks such as inclination of a screw being driven through wooden material and difficulty of feeding screws in the form of a continuous screw chain.

SUMMARY OF THE INVENTION

It is therefore an object of the present invention to eliminate the above-mentioned drawbacks of the prior art, more particularly, to provide a successive screw feeder driver which permits to drive screws in a secure and facilitated manner.

It is another object of the present invention to provide a screw feeder driver which is constructed in a short length as a whole and in a compact form to ensure easy handling and driving of screws at right angles with a workpiece.

It is still another object of the invention to provide a screw feeder driver which has a reduced weight in its front section to lessen the labor which is required in the screw driving operation.

In order to achieve these objectives, the present invention provides a scuccessive screw feeder driver which is characterized by the provision of: a motor housing accommodating an electric motor in a front portion thereof and forming a handle in a base end portion, and mounting a transmission mechanism between the electric motor and the handle; a magazine holding a continuous screw chain consisting of a great number of screws attached at uniform intervals to a connecting strip by means of an easily breakable filament; a screw drive mechanism projected from the front end of the motor housing by a predetermined length parallel with the electric motor for driving the screws; a feeder block having a screw feed mechanism for successively feeding screws on the continuous screw chain from the magazine to a predetermined driving position in front of the screw drive mechanism and adapted to guide the screw chain withdrawn from the magazine in a proper posture along a path leading to the predetermined driving position, the block being constantly urged to project from the front end of the motor housing and retractable over the electric motor at the time of driving a screw.

With this construction, the length of the screw holding block which is projected from the fore end of the motor housing is reduced in the initial stage of the screw driving operation so that one can perform the screw driving job in a secure and facilitated fashion. The heavy transmission mechanism is located in a position close to the handle to reduce the weight on the front side of the screwdriver, for lessening the labor of screw driving operation and making it possible to perform the successive screw driving operation over a long time period without detrimental fatigue on the part of an operator.

The above and other objects, features and advantages of the present invention will become apparent from the following description and appended claims, taken in conjunction with the accompanying drawings which show by way of example some illustrative embodiments of the invention. It is to be understood that the drawings show only preferred forms of the invention and the invention is not limited to the particular forms shown there.

DESCRIPTION OF PREFERRED EMBODIMENTS

Figure 1:
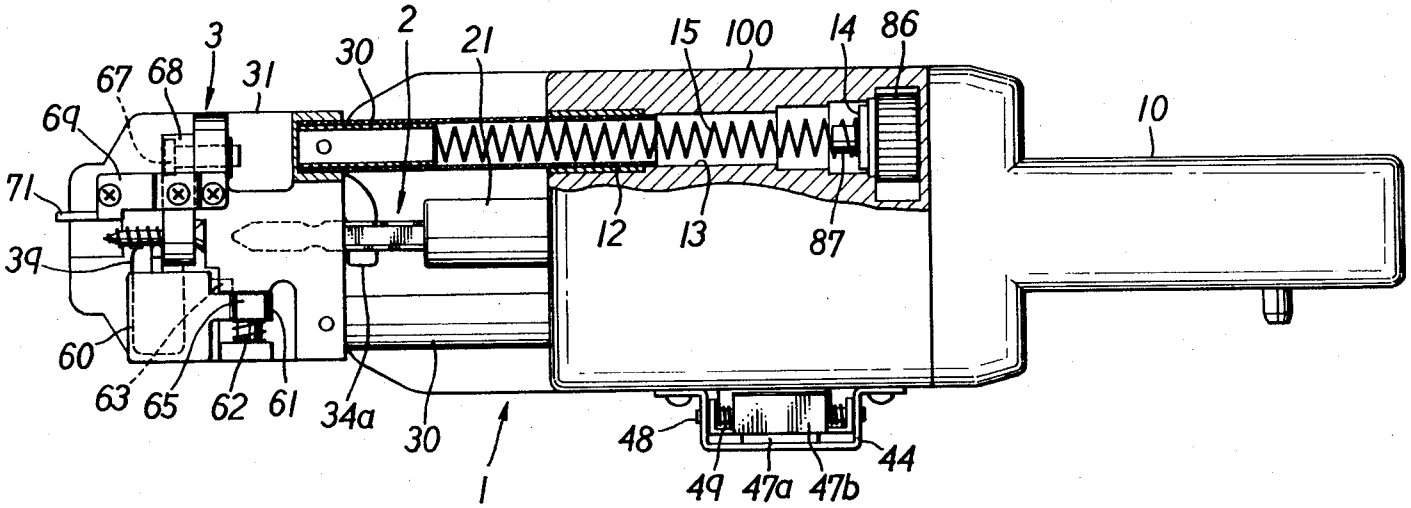
FIG. 1 is a partly cutaway plan view of a successive screw feeder driver according to the present invention, with a screw chain magazine removed.
Figure 2:
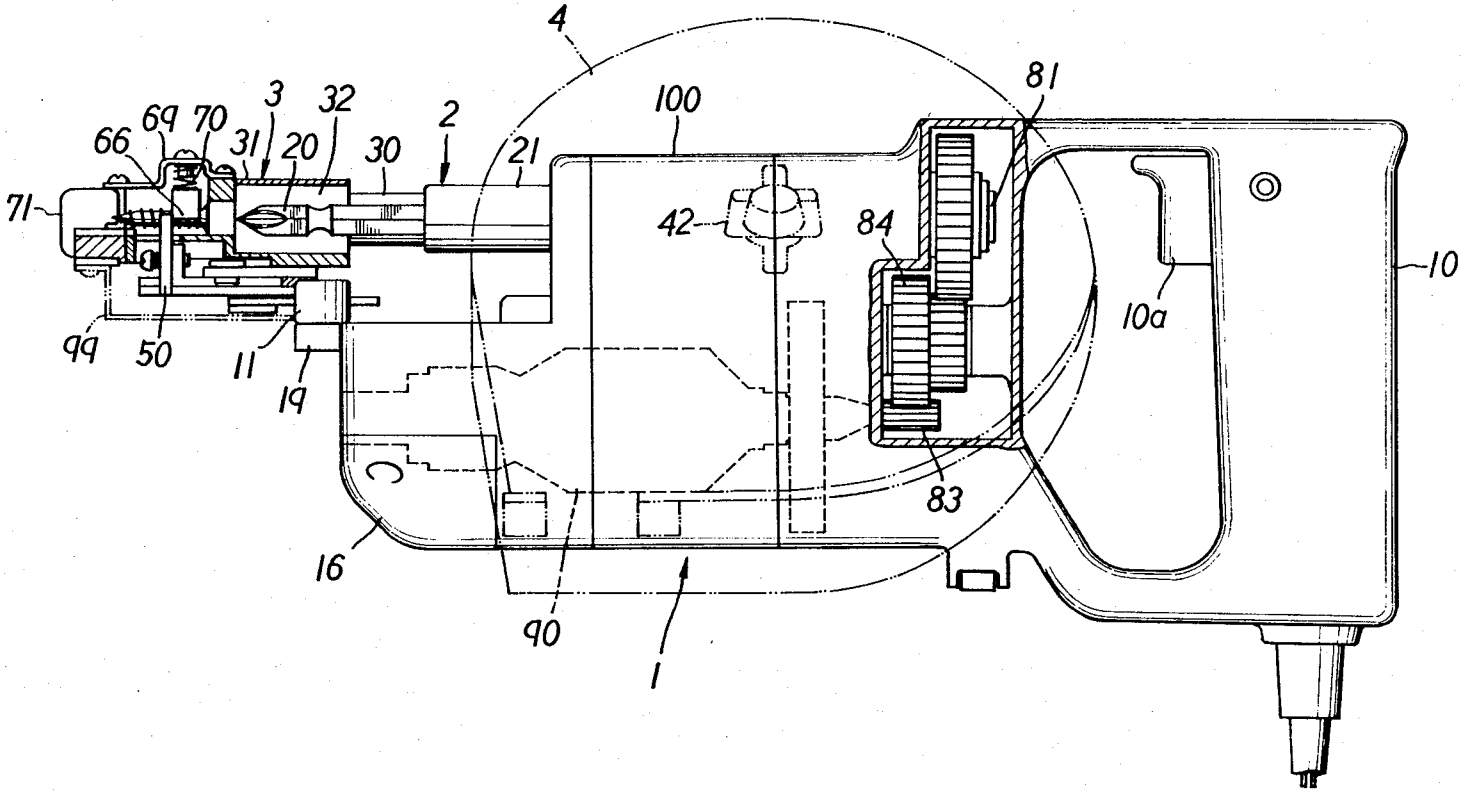
FIG. 2 is a side view of the screw feeder driver of FIG. 1.
Figure 3:
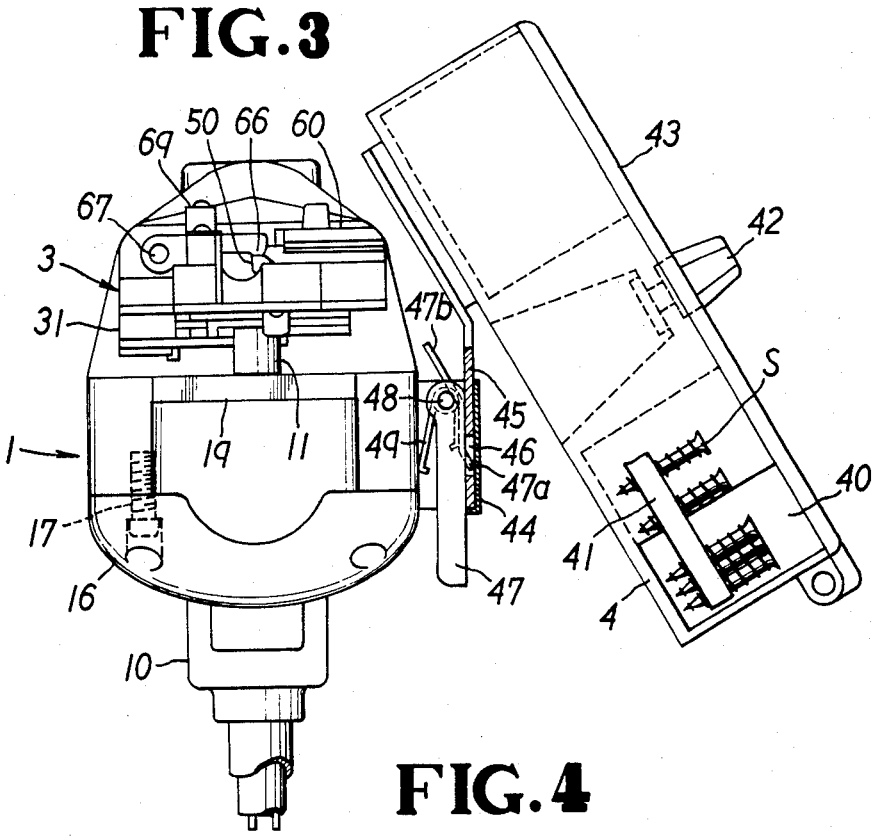
FIG. 3 is a front view of the screw feeder driver with the screw chain magazine mounted in position.

As shown in FIGS. 1 to 3, the successive screw feeder driver according to the present invention basically includes a motor housing 1 which is integrally formed with a handle 10 in a rear portion to permit an operator to grip or carry the screw feeder driver in one hand, a screw driving mechanism 2 protrudable from the front end of the motor housing 1 to drive a screw into a workpiece, a screw feed mechanism 3 provided at the fore end of the screw drive mechanism and projected forward from the motor housing 1 for reciprocating movement over the motor housing at the time of screw driving operation, and a screw chain magazine 4.

The screw chain magazine 4 which is indicated in phantom in FIG. 2 generally has a shallow cylindrical form with a height or depth suitable for receiving screws S in upright positions as seen in the side view of FIG. 3, and is provided with an opening or outlet 40 for withdrawing a screw chain 41 therefrom. The outer end of the screw chain which is withdrawn from the magazine 4 is placed in the screw feed mechanism 3 to feed the screws S successively to a driving position as will be described hereinlater.

The screw chain 41 which carries, for example, about 150 screws S at uniformly spaced positions along its length is received in a spiral form in the magazine 4, laid along the inner periphery of the magazine 4. When one screw chain 41 is entirely consumed, a fresh screw chain 41 is loaded into the magazine 4 by turning a lock member 42 which locks a lid 43 to the body of the magazine 4, to continue screw driving operation. A screw feeder driver is often used for attaching a wooden material B to a ceiling iron frame A, it is necessary to ensure that a screw chain magazine can be attached easily to the screw feeder driver in consideration of the safety of an operator who is required to load a new screw chain into the magazine in an elevated place. In the particular embodiment shown, the magazine 4 is attached to a holder 44 on the side wall of the motor housing.

Further, secured to the bottom of the screw chain magazine 4 is a thin connector strip 45 which is bent half way of its length to form an inclined projection extending outwardly away from the bottom wall of the magazine 4, and provided with a window aperture 46 at the projected end. The magazine holder 44 is projected from the side wall of the motor housing in an extent which is suitable for holding the screw chain magazine 4. A locking plate 47 is pivotally supported on the holder 44 through a pin 48, in a gapped relation with the outer end wall of the holder 44 to permit insertion of the connector strip 45. A spring 49 which is wound on the pin 48 has its one end abutted against the side wall of the motor housing and the other end against the locking plate 47, constantly urging the locking plate 47 to rotate about the pin 48 in a counterclockwise direction in FIG. 3.

The locking plate is provided with a downwardly inclined locking prong 47*a* which is projected from its middle portion toward the outer end wall of the magazine holder 44, and an upper inclined guide strip 47*b* which is provided on its upper side and inclined toward the motor housing 1. The locking plate 47 has its lower half projected downwardly over a substantial length from the lower side of the magazine holder 44, so that the locking prong 47*a* can be moved away from the magazine holder 44 upon pushing the lower projected portion of the locking plate 47 by a finger, rotating clockwise against the action of the spring 49. By so doing, the locking prong 47*a* is disengaged from the window aperture 46 of the thin strip 45, permitting to detach the magazine 4 from the holder 44.

As soon as the finger pressure is removed, the locking plate 47 is rotated counterclockwise by the biasing action of the spring 49, with the locking prong 47*a* abutted against the outer end wall of the holder 44. In this state, when the free end of the connector strip 45 is thrusted into the holder 44 in order to attach the magazine 4 thereto, the connector strip 45 is securely guided into the narrow gap between the locking plate 47 and holder 44 along the guide strip 47*b* and, upon pushing it in against the action of the spring 49, further inserted into the gap until the locking prong 47*a* falls into the window aperture 46 of the connector strip 45. By engagement with the locking prong 47*a*, the connector strip 45 is securely locked to the holder 44.

Figure 6:
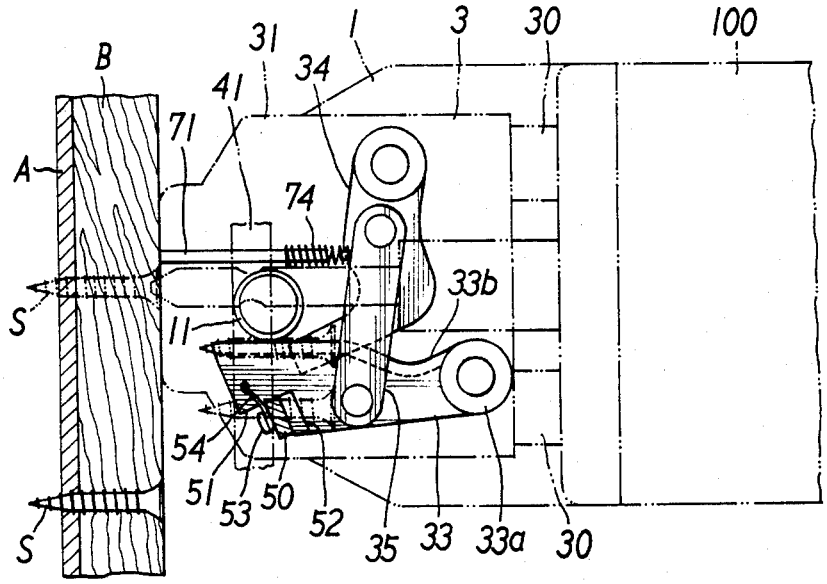
FIG. 6 is a view similar to FIG. 5 but showing the screw feed mechanism in operation.

For holding the screw chain 41 which is withdrawn from the magazine 4 and feeding the screws S successively to a position opposing a bit 20 which drives them one after another into the wooden workpiece B, the screw feed mechanism 3 is forwardly extended from the front end of the motor housing 1 and, as its front end is pressed against the surface of the wooden workpiece B in order to drive a screw S in the manner as shown in phantom in FIG. 6, the screw feed mechanism 3 as a whole is retracted on the upper side of the motor housing 1 along with a pair of pipes 30 which support the screw feed mechanism 3 on the motor housing 1. As soon as the front end of the screw drive mechanism 3 is disengaged from the surface of the wooden workpiece B, the feed mechanism 3 returns to the forwardly protruded position along with the support pipes 30. In order to restrict the forward protrusion of the screw feed mechanism 3, a stop roller 11 is provided at the front end of the motor housing 1.

The pipes 30 which support the screw feed mechanism 3 on the motor housing 1 are located on opposite sides of the screw driving bit 20 and have a feeder block 31 mounted at the fore ends thereof. Rear halves of the support pipes 30 are inserted and slidably supported in receptacle pipes 12 (see FIG. 1) which are provided in an upper portion of the motor housing 1. The receptacle pipes 12 are received in an upper housing 100 which is upwardly projected from the rear portion of the motor housing 1.

Provided in the upper housing 100 are cavities 13 for retracting the support pipes 30 deep into the housing 100. A compression spring 15 is interposed between the inner end of the support pipe 30 and a spring seat 14 which is provided at the inner end of each cavity 13, constantly urging the support pipe 30 to return to the forwardly protruded position.

The above-mentioned feeder block 31 of the screw feed mechanism 3 is centrally provided with a through hole 32 which, in the rear portion of the feeder block, has a diameter suitable for receiving the screw driving bit 20 and the front end portion of a bit support sleeve 21 but substantially at a halfway position of its diameter is reduced to a size which can receive only the screw driving bit 20, the front end of the hole 32 confronting the head of a screw in a driving position. The fore end of the bit 20 is normally positioned immediately behind the smaller diameter portion of the hole 32 as shown in FIGS. 1 and 2.

The mechanism for feeding the screws successively into the predetermined driving position on the block 32 further includes a link mechanism which is mounted on the lower side of the feeder block 31 in combination with a feeding pawl. As shown particularly in FIG. 6, the link mechanism is constituted by a screw feeding lever 33 and a link lever 34 of specific shapes and links 33 and 34 which interconnect the two levers.

Figure 5:
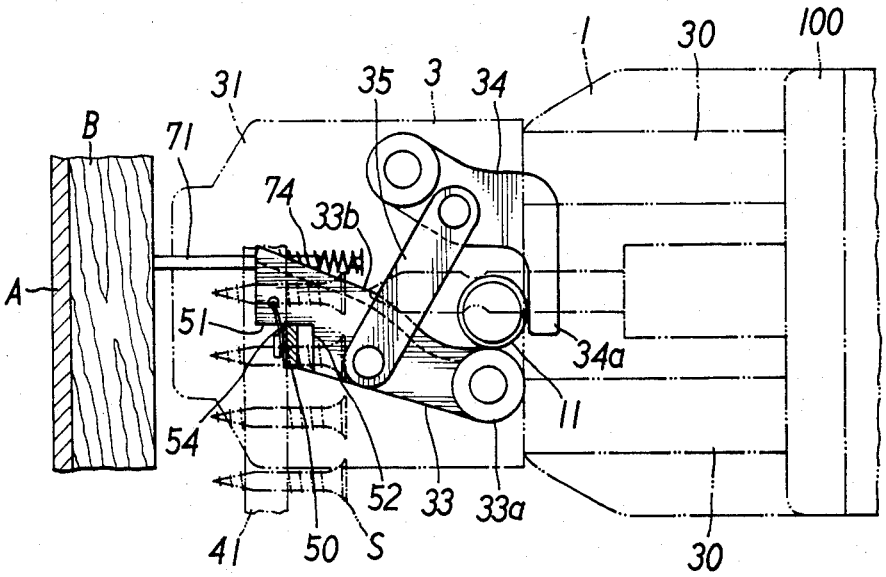
FIG. 5 is a plan view of the screw feed mechanism in non-operating state.

The screw feeding lever 33 is rotatably mounted on the block 31 at its rear end 33*a* (the right-hand end in FIGS. 5 and 6) at a position close to the rear side of the block 31, and has its fore end extended up to a middle portion of a screw S which is located in front of the bit 20. Formed on the inner lateral side of the lever 33 is a dual curve cam surface 33*b* which is in sliding contact with the afore-mentioned stop roller 11. In a normal non-operating state, the stop roller 11 is located in a position behind the feeder block 31 as shown in FIG. 5 and in engagement with the link lever 34, pulling the screw feeding lever 33 toward a screw S in the driving position in front of the bit 20, through the link lever 34 and link 35. However, as the screw feeder driver is pressed against the wooden workpiece B in order to drive the screw S as shown in FIG. 6, the stop roller 11 is moved forward along with the motor housing 1, pushing the cam surface 33*b* and as a result turning the fore end of the screw feeding lever 33 toward an ensuing screw of the screw chain 41. This action is related with the operation of a screw advance pawl 50 which is provided at the fore end of the screw feeding lever 33.

As seen in FIGS. 4 and 5 and FIGS. 2 and 3, the screw advance pawl 50 has its lower portion abutted against a notch 51 which is formed at the front end of the screw feeding lever 33, and is pivotally mounted by a pin 53 on an upright support wall or bracket 52 rising from the notched end 51. The screw advance pawl 50 is constantly urged to rotate about the pin 53 clockwise in FIG. 4 by the action of a spring 54 which is mounted on the pin 53 with one end thereof stopped in the screw feeding lever 33 and the other end in the screw advance pawl 50. In this instance, the screw advance pawl 50 which is abutted against the notch 51 in its lower portion is blocked against rotation in clockwise direction even if the spring 54 tends to rotate the pawl 50 in that direction, and remains in the upright position on the screw feed lever 33. However, the pawl 50 can be easily rotated in counterclockwise direction against the action of the spring 54.

The screw chain 41 is located on the front side of the feeder block 31, while the screw feeding lever 33 is located on the back side of the block 31. Therefore, in order to let the fore end of the advance pawl 50 act directly on a middle portion of the screw S, it is extended through a window aperture 39 of a suitable size which is formed in the feeder block 31.

The screw advance pawl 50 with the foregoing construction is rocked in the window aperture 39 as the fore end of the screw feeding lever 33 is swung into the position of FIG. 6 from the position of FIG. 5. The screw chain 41 which is slidingly fed on and along the feeder block 31 which forms the frame of the window aperture 39 carries the screws S at uniform intervals, so that the fore end of the screw advance pawl 50 is abutted against an ensuing screw as it is rocked in the window aperture 39. In this instance, however, the fore end of the pawl 50 is easily turned counterclockwise about the pin 53 against the action of the spring 54 and passed under the abutted screw. By this movement of the pawl 50 ducking under the screw, it immediately returns to the upright position under the influence of the action of the spring 54. Then, as the screw feeding lever 33 returns to the position of FIG. 5, it is abutted against a middle portion of the ensuing screw S, pushing same to a center position on the block 31. In this manner, the screws S on the screw chain 41 are moved forward by one pitch every time a screw S in the head position is driven into the wooden workpiece B, sending the screws successively to a predetermined driving position on the feeder block 31.

The link lever 34 which is also mounted on the back side of the feeder block 31 serves to effect the above-described rocking motions in an accurate and secure manner. The link lever 34 is connected to the screw feeding lever 33 by a link 35, and provided with a finger portion 34*a* to be abutted against the back of the stop roller 11 when the feeder block 31 and support pipes 30 are in a forwardly protruded position relative to the upper housing 100 to limit further protrusion of the feeder block 31 from the upper housing 100. This trend toward rotation which is imparted to the link lever 34 upon abutment of its finger portion 34*a* against the stop roller 11 urges the screw advance pawl 50 to push the ensuing screw S securely into the predetermined drive position on the feeder block 31, due to the above-described linkage of the respective levers and link.

The screw chain 41 on the feeder block 31 should be properly fed along a predetermined path without permitting meandering or other irregular deviational movements of the screw chain including the bulky screw heads. For this purpose, the feeder block 31 is provided with a groove 38 behind the window aperture 39 as shown in FIGS. 4 and 7 for receiving the bulged screw heads, and a lid member 60 which presses the screw chain 41 on the feeder block 31.

Figure 4:
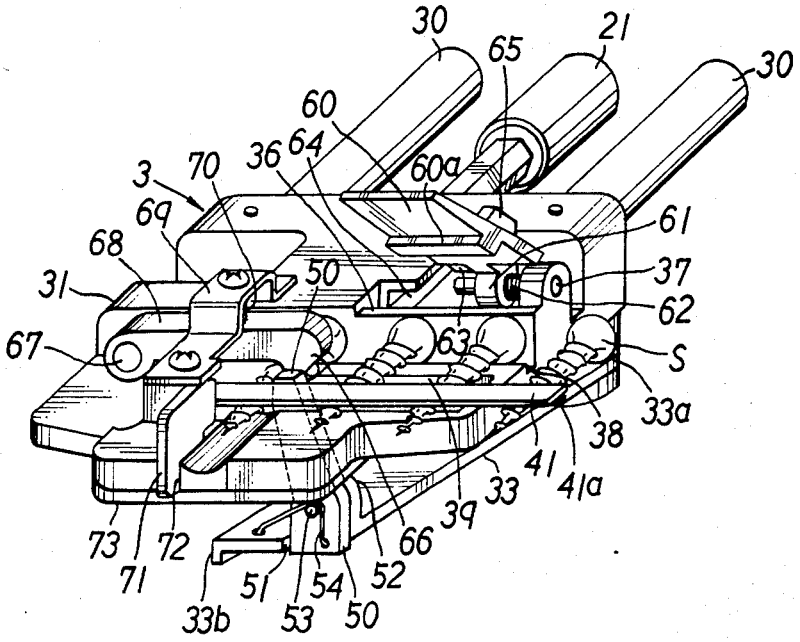
FIG. 4 is a perspective view of a screw feed mechanism.
Figure 7:
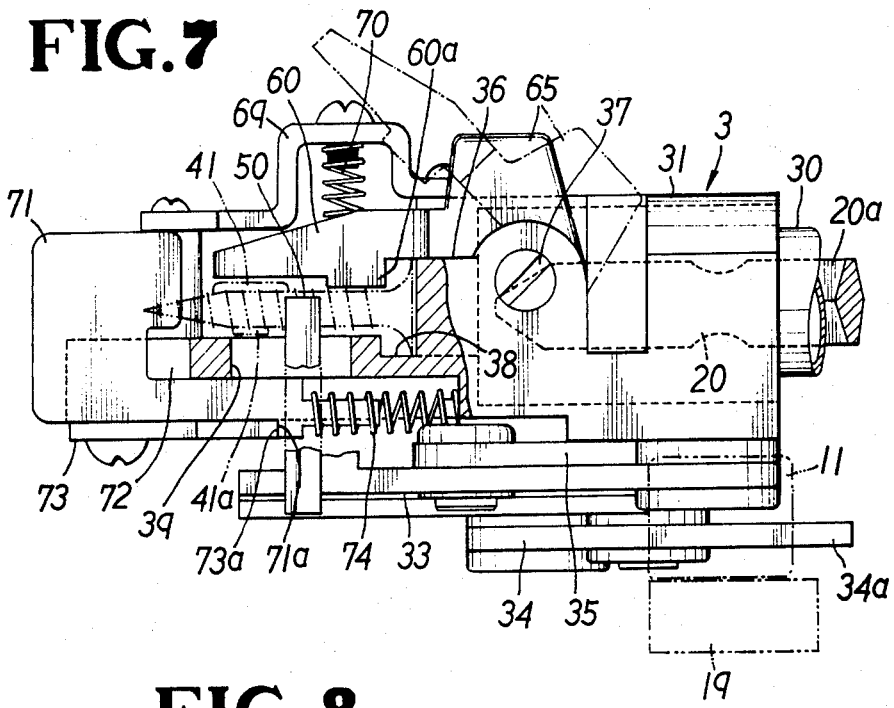
FIG. 7 is a partly cutaway side view of the screw feed mechanism.

The pressing lid 60 has a size which is large enough for covering a major area of the window aperture 39, and rockable upwardly as indicated in FIG. 4 (in phantom) and FIG. 7 (in solid line) about a pin 37 which is mounted on the feeder block 31. The lid 60 is swung open into the upper position in order to facilitate setting of the screw chain 41 in a predetermined position on the feeder block 31 or removal of the chain 41 therefrom.

As the pressing lid 60 is closed on the screw chain 41 after setting the screw chain in position on the feeder block 31, a hinge portion 61 of the lid 60 is pushed to slide slightly inward on a bank portion 36 of the feeder block 31 in the axial direction of the pivoting pin 37 under the influence of the action of a compression spring 62 which is mounted on the pin 37. The bank portion 36 which engages the lower side of the lid member 60 prevents further pressing action on the screw chain 41.

When the lid member 60 is slided on the bank portion 36 as mentioned hereinbefore, a locking prong 63 (indicated by broken line in FIG. 1) which is formed on the pressing lid 60 drops into a recess 64 on the feeder block 31, locking the pressing lid 60 in the closed position on the feeder block 31. Therefore, in order to open the pressing lid 60, it is necessary to disengage the locking prong 63 from the recess 64 by slightly pulling back the lid 60 along the pin 37. The lid 60 is provided with a knob 65 on its upper side for the purpose of facilitating the just-mentioned pull-back operation. On the lower or inner side, the pressing lid 60 is provided with a ridge portion 60*a* which holds the heads of screws S in cooperation with the bank portion 36 when the pressing lid 60 is closed on the screw chain 41, restricting sideward movements of the screw chain 41.

A screw holding pawl 66 is mounted on the upper side of the feeder block 31 by a pin 67 thereby to prevent spontaneous movements of the screw chain which is set in position on the feeder block 31. The pawl 66 is adapted to hold one side of a screw S in a position opposing the screw advance pawl 50 but to abut on the same side of the screws as the screw advance pawl 50, and provided with a small downward projection at the distal end of a square rod 68 which is hung over a leading screw S. However, the screw holding pawl 66 might make it difficult to set the screw chain 41 on the feeder block 31. To solve this problem, a spring 70 is interposed between the screw holding pawl 66 and a bridge member 69 which is fixed over and across the screw holding pawl 66, urging the square rod portion 68 toward the leading screw S to ensure positive pressing action of the pawl 66 and at the same time permitting the square rod portion 68 to be turned upwardly about its pivoting pin 67 against the action of the spring 70 to open a space for receiving a screw S into the predetermine driving position.

Although the screw holding pawl 66 constantly holds a leading screw S in position in the manner as described above, it is pushed upward against the force of the spring 70 by the bit 20 when the latter is propelled to drive the screw S into the wooden workpiece B, without interfering with the movement of the bit 20 which passes under the pawl 66. As an ensuing screw is fed forward by the screw advance pawl 50, the screw holding pawl 66 is pushed up by the screw, letting the latter advance to the predetermined driving position. The screw holding pawl 66 is provided with an inclined surface at the inner end so that it can be easily lifted up by the abutting screw.

In order to drive a screw S into the wooden workpiece B, an operator grips the handle 10 and holds the nose end of the screw feeder driver against the wooden workpiece as shown in FIG. 5. Upon pressing the screw feeder driver against the workpiece B, a pressing plate 71 which is projected on the front side of the feeder block 31 is retracted into a slot 72 which is formed at the front end of the feeder block 31. The pressing plate 71 is prevented from comming off the slot 72 by a cover plate 73 which is attached to the underside of the feeder block 31 as shown in FIG. 7 and the bridge member 69 of the screw holding pawl 66. The pressing plate 71 is constantly urged to protrude by a small length from the front end of the feeder block 31 by a spring 74 which is mounted in a recess provided on the underside of the block 31, restricting the length of projection of the pressing plate 71 by abutting engagement of a stepped portion 71*a* of the pressing plate 71 with a rear extension 73*a* of the cover plate 73 which is attached to the underside of the feeder block 31.

Upon pressing the screw feeder driver on the wooden workpiece B, the front end of the pressing plate 71 is retracted flush with the front end of the feeder block 31 as shown in FIG. 6. At this time, the rear end of the pressing plate 71 is pushed against a synthetic resin strip 41*a* of the screw chain 41, pushing the latter slightly rearward.

When setting on the feeder block 31 the screw chain 41 which is withdrawn from the magazine 4, the chain 41 is apt to be pulled obliquely rearward due to the positional relationship between the magazine 4 and feeder block 31, causing the screw S to incline slightly in the driving position on the feeder block 31. Therefore, if the screw S is driven into the workpiece B by the bit 20 in that state, it will naturally go through the wooden workpiece B and then into the iron plate A in the inclined state. This is undesirable in view of not only the extremely large force which will be required for driving such screws, but also reductions in the force of joining a wooden material B to an iron plate A and degradations in the appearance of driven screw heads on wooden material B.

However, by the above-mentioned action of the pressing plate 71 which pushes up the screw chain 41, the screws S on the feeder block 31 are kept from inclinations and can be driven into the wooden workpiece B in a perpendicular direction or at the angle with which the screw feeder driver is abutted against a workpiece.

As soon as removing the screw feeder driver from a wooden workpiece B, the pressing plate 71 is immediately protruded by a predetermined length under the influence of the spring 74, relieving the screw chain 41 of its pressing force to permit chain feed in a predetermined direction on the feeder block 31.

If the screwdriver is pressed against a wooden workpiece B for driving a screw thereinto, the block 31 is retracted over the motor housing 1 along with the support pipes 30, and as a result the bit 20 which is protruded by a predetermined length from the upper housing 100 comes into engagement with the head of a leading screw S on the feeder block 31. As the screwdriver is pressed further, the feeder block 31 is retracted further rearward on the motor housing 1, causing the bit 20 to push the screw S forward on the feeder block 31 and stab it into the wooden workpiece B, tearing off the connecting strip of the chain 41. Whereupon, the bit 20 receives a rearward propelling force and it is only after this that rotation is imparted to the bit 20.

Figure 8:
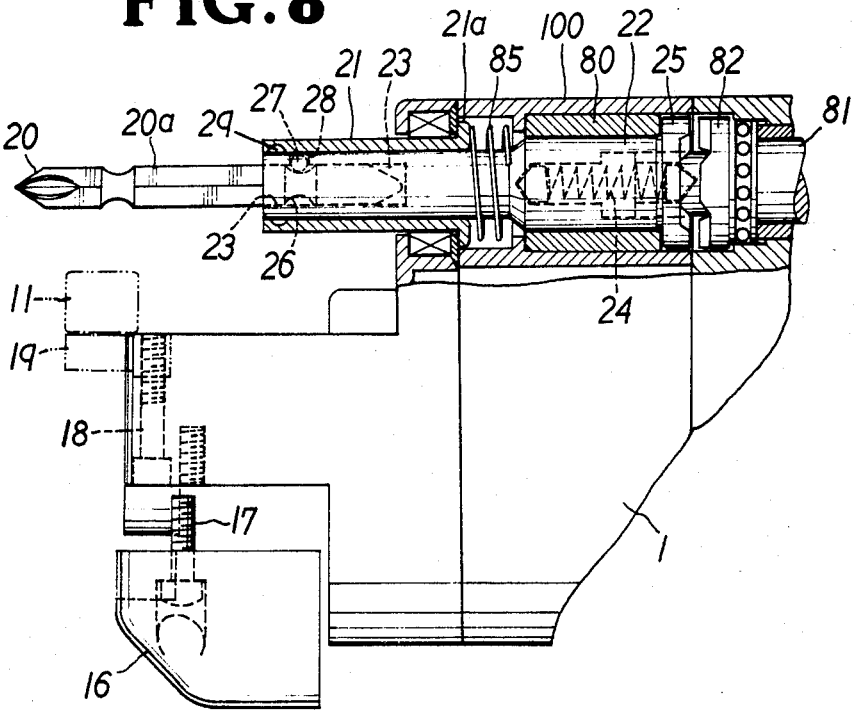
FIG. 8 is a side view of the screw feeder driver with a cover removed from a lower section at the front end of a motor housing, showing a screw drive mechanism in section.

As shown in FIG. 8, the bit 20 is coupled with a bit rotating shaft 22 which is rotatably supported in the upper housing 100 through bearing 80 and which is slightly slidable in rearward direction. A female clutch 25 which is formed at the rear end of the bit rotating shaft 22 is urged forward for abutting engagement with the bearing 80 by a spring 24 (indicated in phantom in FIG. 8) which is interposed between the bit rotating shaft 22 and a rear transmission shaft 81, normally disengaging the female clutch 25 from an opposing male clutch 82 at the fore end of the transmission shaft 81. Therefore, when a rearward propelling force occurs to the bit 20 as mentioned hereinbefore, the bit rotating shaft 22 is slided rearward against the action of the spring 24, engaging the female clutch 25 with the male clutch 82 at the fore end of the transmission shaft 81 to transmit rotation to the bit rotating shaft 22. By rotating of the bit 20, the screw S is driven into the wooden workpiece B.

The transmission shaft 81 is driven from an electric motor 90 which is actuatable by means of a button switch 10*a* provided on the handle 10 as seen in FIG. 2. The rotation of output shaft 83 of the electric motor 90 is transmitted to the transmission shaft 81 after speed reduction through a transmission gear mechanism 84 which is mounted in the rear portion of the upper housing 100, that is to say, in the motor housing 1 at a position on the side of the handle 10, to rotate the transmission shaft 81 at low speed. Even if the transmission shaft 81 is rotationally driven from the electric motor 90 by depression of the button switch 10*a*, the bit 20 is not rotated until the female clutch 25 of the bit rotating shaft 22 is engaged with the male shaft 82 on the transmission shaft 81.

The bit 20 is required to engaged the groove in the head of a hard steel screw S and to drive same through the wooden workpiece B and into the iron plate A as shown in FIG. 6. Although the fore end of the bit 20 is formed of a hard material, its edges are rounded off when used for driving a great number of screws S. Therefore, it is desirable that the bit 20 be easily detachable from the bit rotating shaft 22 for replacement by a fresh one. For this purpose, the fore end of the bit rotating shaft 22 is projected from the front side of the upper housing 100, and a square hole 23 is formed in the projected portion to receive the rear end (which is also formed into a bit) of a square shank portion 20*a* of the bit 20. A steel ball 27 (indicated by broken line in FIG. 8) is fitted in a small hole 28 which is bored in the bit rotating shaft 22, so that the ball 27 snugly fit in a groove 26 formed in the rear portion of the square shank portion 20*a*, thereby preventing the bit 20 from being spontaneously extracted from the bit rotating shaft 22. A sleeve 21 which is fitted on the bit rotating shaft 22 to hold the steel ball 27 in the hole 28 is provided with a recess 29 on the inner periphery of its fore end portion, so that, if the sleeve 21 is retracted to register the recess 29 on the small hole 28, the steel ball 27 is partly received in the recess 29. Consequently, if the square shank portion 20*a* of the bit is pulled in a direction away from the bit rotating shaft 22, the steel ball 27 is pushed upwardly in the small hole 28 by a sloped surface of the groove 26 on the square shank 20*a*, unlocking the square shank 20 and bit rotating shaft 22 from each other to permit extraction of the shank portion 20*a* from the square hole 23.

In order to hold the recess 29 of the sleeve 21 out of register with the small hole 28 for normally preventing spontaneous release of the bit 20 from the bit rotating shaft 22, a flanged wall 21*a* at the rear end of the sleeve 21 is engaged with a spring 85 which is mounted in the upper housing 100 to urge the sleeve 21 forward. Therefore, when it is desired to extract the bit 20 from the bit rotating shaft 22, the sleeve 21 is pushed in slightly against the action of the spring 85 until the groove 29 comes into alignment with the small hole 28.

There sometimes arises a necessity for adjusting the screw driving depth prior to actually driving screws S into a wooden workpiece B. To permit fine adjustments on such an occasion, an adjustor ring 86 is provided in associated with one of the pipes 30 which support the feeder block 31 as shown in FIG. 1, thereby to adjust the position of the stopper plate 14 which limits the rearward movement of the feeder block 31 by hitting against the rear ends of the pipes 30 when the latter are retracted into the cavities 13 in the upper housing 100. Part of knurled circumferential surface of the adjustor ring 86 is exposed from the housing 100 so that it can be easily rotated by a finger. Upon turning the adjustor ring 86, the stopper plate 14 which is engaged with a female screw of the ring 86 is slided along a square shaft 87 to vary its position. When the stopper plate 14 is on a fore end portion of the square shaft 87, the pipes 30 are retractable over a relatively shaft distance. In such a case, the feeder block 31 is also retractable over a relatively short distance and the position of the bit 20 is accordingly shifted rearward at the retraction of the feeder block 31 with a reduced screw driving depth.

Further, there may arise a need for driving other screws by the use of the bit 20 alone. In order to reply such a need, the screw feeder driver of the present invention is provided with a mechanism for removing the stop roller 11. However, if the stop roller 11 is removed from its position at the fore end of the motor housing 1, the finger portion 34*a* of the link lever 34 which limits the projection of the feeder block 31 by engagement with the roller 11 becomes free so that the feeder block 31 will be caused to pop out abruptly together with the support pipes 30 by the action of the compression spring 15, which is very dangerous. To prohibit easy removal of the stop roller 11, the lower cover 16 at the front end of the motor housing 1 is fixed in position by screws 17 as shown in FIG. 8, and a stop roller support plate 19 is fixed to the front end of the motor housing 1 likewise by set-screws 18 (shown in phantom in FIG. 8). Thus, the stop roller support plate 19 can not be detached from the fore end of the motor housing 1 even if the screws 18 are loosened to some extent, but it can be dismantled from the position at the fore end of the motor housing 1 together with the stop roller 11 by removing the set-screws 18 after detaching the lower cover 16 and its set-screws 17 as shown in FIG. 8.

The screw chain 41 is formed by placing steel screws S at predetermined uniform intervals on the back side of a broad synthetic resin strip 41*b* and fixing the screws on the resin strip by a synthetic resin filament 41*a* of small gauge which is bonded to the back side of the resin strip 41*b*. As the bit 20 drives a leading screw S on the feeder block 31, only the filament 41*a* which has been holding the driven screw S to the strip 41*b* is broken to ensure faciliated sliding movement of the screw. The broken filament portion remains on the resin strip 41*b* which is intermittently advanced to the opposite side of the feeder block 31 through a passage between the pressing plate 71 on the block 31 and the square rod 68 of the screw holding pawl 66.

The screw feeding mechanism on the underside of the feeder block 31 is provided with a cover 99, as indicated by chain line in FIG. 2, which is mounted in position clear of the stop roller 11.

Although the invention has been described in terms of a specific example, it is to be understood that other forms of the invention may be readily adapted within the scope of the invention.

What is claimed is:

1. A successive screw feeder driver, comprising in combination;

a motor housing accommodating an electric motor in a front end portion thereof and forming a handle in a base end portion thereof, mounting a transmission mechanism between said electric motor and handle;

a screw chain magazine detachably fixed to said motor housing and holding an elongated screw chain having a large number of screws attached at uniform intervals to a connecting strip by means of a breakable filament;

a screw driving mechanism projected from the front end of said motor housing by a predetermined length in parallel relation with said electric motor for driving said screws;

a feeder block mounting thereof a screw feed mechanism for successively feeding screws on the screw chain from said magazine one after another to a predetermined driving position in front of said screw driving mechanism, and adapted to hold the screw chain withdrawn from said magazine;

a support member for supporting said feeder block on said motor housing and normally projecting said feeder block from the front end of said motor housing by a predetermined length, said support member being retractable into said motor housing at the time of screw driving operation; and a screw advance mechanism for advancing screws on said screw chain one after another to said predetermined driving position on said feeder block.

2. A successive screw feeder driver as set forth in claim 1, further comprising a holder attached to a side wall of said motor housing and detachably connectible to said screw chain magazine.

3. A successive screw feeder driver as set forth in claim 2, wherein said holder comprises a pivotally supported locking plate constantly urged toward an opposing end wall of said holder by a spring, and said screw chain magazine is provided with a connector strip interlockable with said locking plate upon insertion between said locking plate and end wall of said holder and detachable by turning said locking plate away from said holder end wall against the action of said spring.

4. A successive screw feeder driver as set forth in claim 1, wherein said support member is constituted by a pair of pipes retractable into an upper housing provided on said motor housing on the side of said handle and constantly urged toward a projected position by springs mounted in said upper housing.

5. A successive screw feeder driver as set forth in claim 4, further comprising a stopper provided on said motor housing to limit the length of retraction of said pipes into said upper housing.

6. A successive screw feeder driver as set forth in claim 1, wherein said screw advance mechanism comprises a screw feed lever pivotally mounted on said feeder block and a screw advancing pawl adapted to be abutted against a screw by rocking movement of said screw feed lever for advancing said screw to said driving position in front of said screw driving mechanism.

7. A successive screw feeder driver as set forth in claim 6, wherein said screw feed lever is provided with a cam surface for engagement with a stop roller mounted on said motor housing and adapted to run along said cam surface in relation with back and forth reciprocating movement of said feeder block.

8. A successive screw feeder driver as set forth in claim 7, wherein said screw advance mechanism comprises a link having opposite ends thereof pivotally connected to said screw feed lever and a link lever, respectively, said link lever being rockably supported on said feeder block and having a finger portion for abutting engagement with a roller to restrict the projection of said feeder block.

9. A successive screw feeder driver as set forth in claim 1, wherein said feeder block is provided with a screw holding pawl for retaining a leading screw of said screw chain in position in front of said screw driving mechanism to prevent spontaneous movement of said screw.

10. A successive screw feeder driver as set forth in claim 1, wherein said feeder block is provided with a groove engageable with heads of screws for guiding same securely toward said driving position.

11. A successive screw feeder driver as set forth in claim 10, wherein the top of said groove is normally closed by a chain pressing lid rockable toward and away from said groove.

12. A successive screw feeder driver as set forth in claim 1, wherein said feeder block is provided with a retractable nose plate at the fore end thereof, said nose plate being retracted into said block upon driving a screw and adapted to push said screw chain to prevent inclination of screws.

13. A successive screw feeder driver as set forth in claim 1, wherein said screw driver mechanism is connectible to said transmission mechanism through a clutch.

14. A successive screw feeder driver as set forth in claim 1, wherein said screw driving mechanism includes a screw driving bit and a sleeve detachably supporting said bit.

15. A successive screw feeder driver as set forth in claim 14, further comprising a steel ball interposed between said bit and sleeve for locking said bit securely in position in said sleeve, and adapted to release the locking action thereof upon moving said sleeve axially relative to said bit to permit extraction of said bit from said sleeve.

16. A successive screw feeder driver as set forth in claim 1, wherein said block and stop roller are detachably mounted on said motor housing.

* * * * *